US008454378B2

(12) United States Patent
Osterhart et al.

(10) Patent No.: US 8,454,378 B2
(45) Date of Patent: Jun. 4, 2013

(54) CONNECTOR

(75) Inventors: Michael Paul Osterhart, Milford, MI (US); Kent Edward Younglove, Monroe, MI (US)

(73) Assignee: Yazaki North America, Inc., Canton, MI (US)

( * ) Notice: Subject to any disclaimer, the term of this patent is extended or adjusted under 35 U.S.C. 154(b) by 71 days.

(21) Appl. No.: 13/222,627

(22) Filed: Aug. 31, 2011

(65) Prior Publication Data

US 2013/0052850 A1 Feb. 28, 2013

(51) Int. Cl.
*H01R 13/28* (2006.01)

(52) U.S. Cl.
USPC ..... 439/284

(58) Field of Classification Search
USPC ..... 439/284, 283, 290, 292–294, 357, 439/595, 206–216, 603
See application file for complete search history.

(56) References Cited

U.S. PATENT DOCUMENTS

| | | | | |
|---|---|---|---|---|
| 3,054,078 | A * | 9/1962 | Baschkin | 439/44 |
| 3,259,870 | A | 7/1966 | Winkler | |
| 3,467,942 | A * | 9/1969 | Stoyer et al. | 439/293 |
| 3,654,586 | A * | 4/1972 | Winkler | 439/295 |
| 3,676,833 | A * | 7/1972 | Johnson | 439/295 |
| 4,405,192 | A * | 9/1983 | Eaby et al. | 439/358 |
| 4,737,118 | A * | 4/1988 | Lockard | 439/295 |
| 5,490,785 | A | 2/1996 | Hein et al. | |
| 5,509,819 | A | 4/1996 | Stein, Sr. et al. | |
| 6,089,898 | A * | 7/2000 | Lincoln et al. | 439/357 |
| 6,126,473 | A | 10/2000 | Whorton | |
| 6,773,167 | B2 | 8/2004 | Scanzillo | |
| 7,059,889 | B1 | 6/2006 | Pavlovic et al. | |
| 7,118,423 | B2 * | 10/2006 | Kobayashi et al. | 439/682 |
| 7,156,686 | B1 | 1/2007 | Sekela et al. | |
| 7,568,938 | B2 | 8/2009 | Siev et al. | |
| 2005/0014409 | A1 * | 1/2005 | Yang et al. | 439/290 |
| 2006/0178029 | A1 * | 8/2006 | Fabian | 439/284 |
| 2009/0163086 | A1 | 6/2009 | Janulis et al. | |
| 2010/0029129 | A1 | 2/2010 | Cox et al. | |

FOREIGN PATENT DOCUMENTS

| | | | |
|---|---|---|---|
| CN | 2378847 | Y | 5/2000 |
| JP | 2001266972 | A | 9/2001 |

* cited by examiner

*Primary Examiner* — Edwin A. Leon
*Assistant Examiner* — Harshad Patel
(74) *Attorney, Agent, or Firm* — Harness, Dickey & Pierce, P.L.C.

(57) ABSTRACT

A connector is provided that may include first and second housings. The first housing may include a first body and a lock arm. The first body may include a first receptacle. The lock arm may be pivotably coupled to the first body. The second housing may include a second body having a second receptacle and a support member. The first and second housings may be engageable with each other in a first position and a second position and movable relative to each other from the first position to the second position. The lock arm may be deflectable relative to the support member when the first and second housings are in the first position. The support member may restrict deflection of the lock arm when the first and second housings are in the second position.

23 Claims, 7 Drawing Sheets

CONNECTOR

FIELD

The present disclosure relates to a connector.

BACKGROUND

This section provides background information related to the present disclosure and is not necessarily prior art.

Electrical connector assemblies may provide robust and convenient means for connecting one or more wires or electrical conductors to one or more other wires or electrical connectors for electrical communication therebetween. Typical connector assemblies include a male connector that is received into a female connector. While these typical connector assemblies have generally been adequate for electrically coupling two or more wires, the need to manufacture and inventory two different connector pieces (i.e., the male connector and the female connector) can be costly and can complicate assembly processes.

SUMMARY

This section provides a general summary of the disclosure, and is not a comprehensive disclosure of its full scope or all of its features.

In one form, the present disclosure provides a connector that may include first and second housings. The first housing may include a first body and a lock arm. The first body may include a first receptacle. The lock arm may be pivotably coupled to the first body. The second housing may include a second body having a second receptacle and a support member. The first and second housings may be engageable with each other in a first position and a second position and movable relative to each other from the first position to the second position. The lock arm may be deflectable relative to the support member when the first and second housings are in the first position. The support member may restrict deflection of the lock arm when the first and second housings are in the second position.

In another form, the present disclosure provides an assembly that may include first and second wires, and first and second housings. The first and second wires may include first and second terminals, respectively. The first housing may include a first body and a first lock arm. The first body may include a first receptacle and a first support member. The first lock arm may be pivotably coupled to the first body and adapted to engage the first terminal. The second housing may include a second body and a second lock arm. The second body may include a second receptacle and a second support member. The second lock arm may be pivotably coupled to the second body and adapted to engage the second terminal. The second housing may be identical to the first housing and may engage the first housing to electrically connect the first and second wires. The first support member may support the second lock arm and restrict deflection of the second lock arm when the first and second housings are in a fully assembled position.

In another form, the present disclosure provides a connector that may include a pair of identical housings. Each housing may include first and second receptacles, first and second lock arms, and first and second support members. The first support member of one housing may be received between the first support member and first lock arm of the other housing. The first receptacle of the one housing may be axially aligned with of the second receptacle of the other housing.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
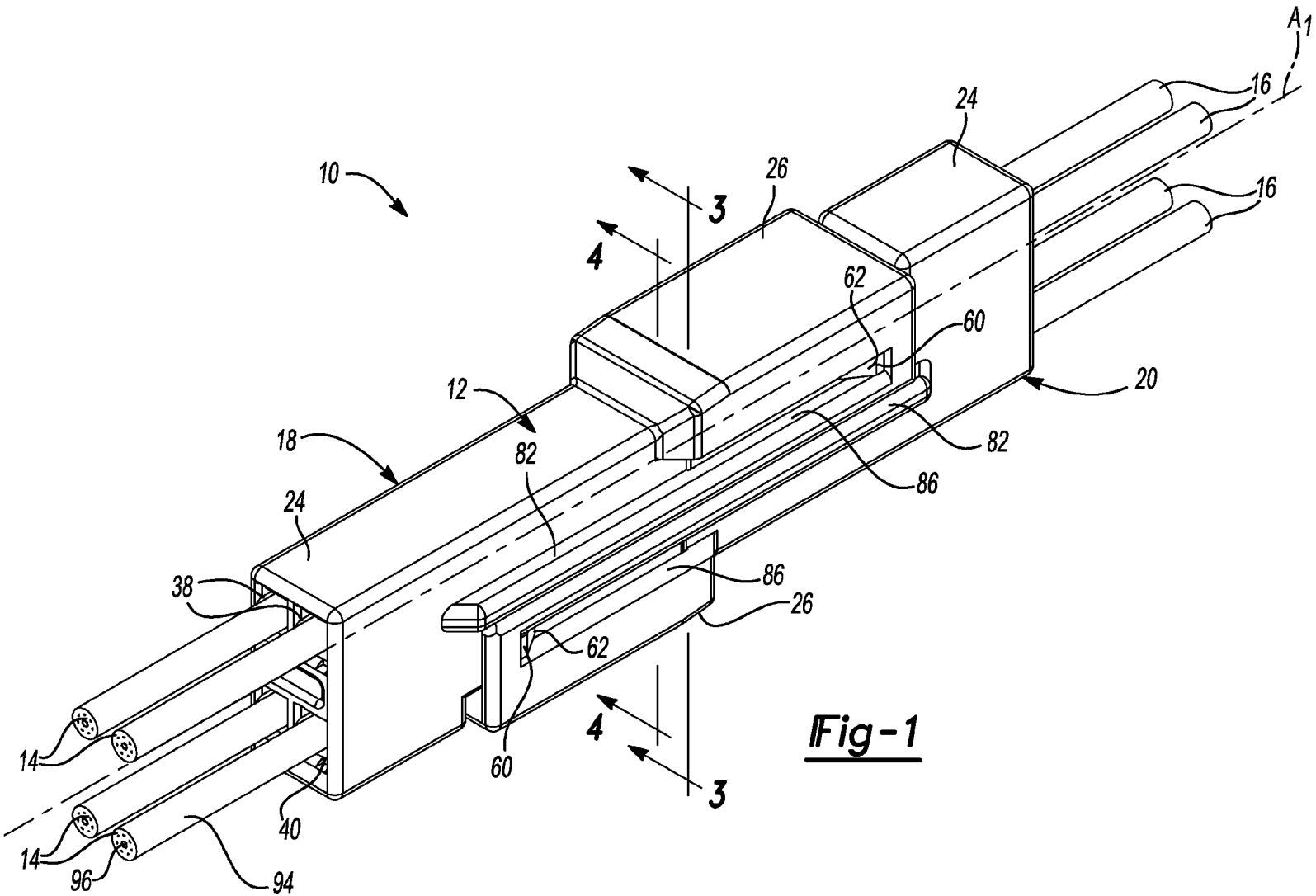
FIG. 1 is a perspective view of an exemplary connection constructed in accordance with the teachings of the present disclosure, the exemplary connection including a connector assembly having first and second housings electrically connecting a plurality of wires, the first and second housings being disposed in a full-set position.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
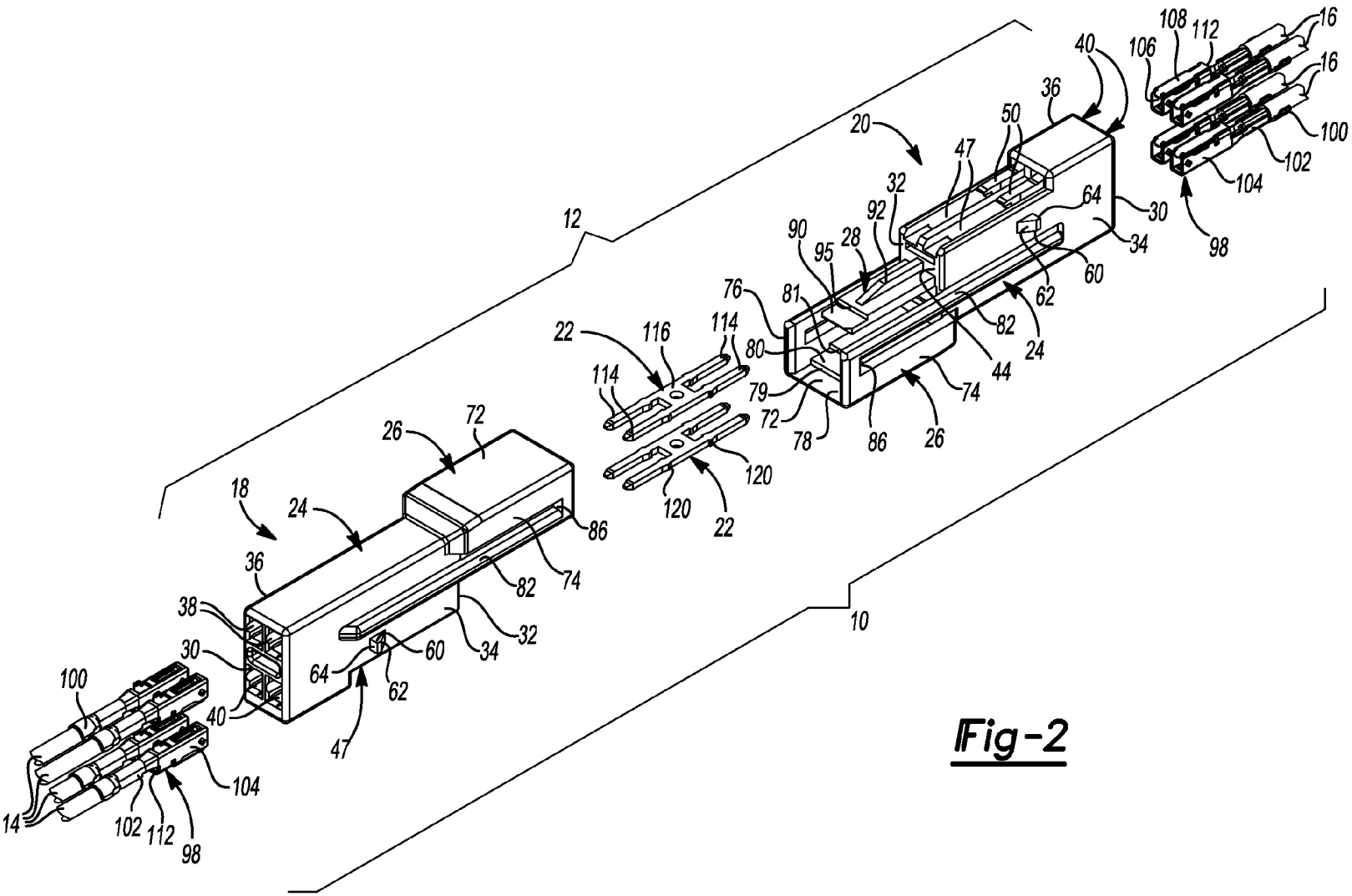
FIG. 2 is an exploded perspective view of the connection of FIG. 1.

With reference to FIGS. 1 and 2, a connection constructed in accordance with the teachings of the present disclosure is generally indicated by reference numeral 10. The connection 10 can include a connector assembly 12, one or more first insulated wire conductors 14, and one or more second insulated wire conductors 16. The connector assembly 12 may engage and electrically connect the first insulated wire conductors 14 with the second insulated wire conductors 16 for electrical communication therebetween.

With reference to FIG. 2, the connector assembly 12 may include a first housing 18, a second housing 20, and one or more busbars 22. The first and second housings 18, 20 may be substantially similar or identical to each other. Therefore, throughout the present disclosure, features of the first housing 18 will be identified by the same reference numerals as similar or identical features of the second housing 20. As will be subsequently described, the first and second housings 18, 20 may be hermaphroditic (i.e., a portion of the first housing 18 may be received in a portion of the second housing 20, and a portion of the second housing 20 may be received in a portion of the first housing 18) and may engage each other in a pre-set position (shown in FIGS. 7-9) and a full-set position (shown in FIGS. 1, 3, and 4).

Figure 3:
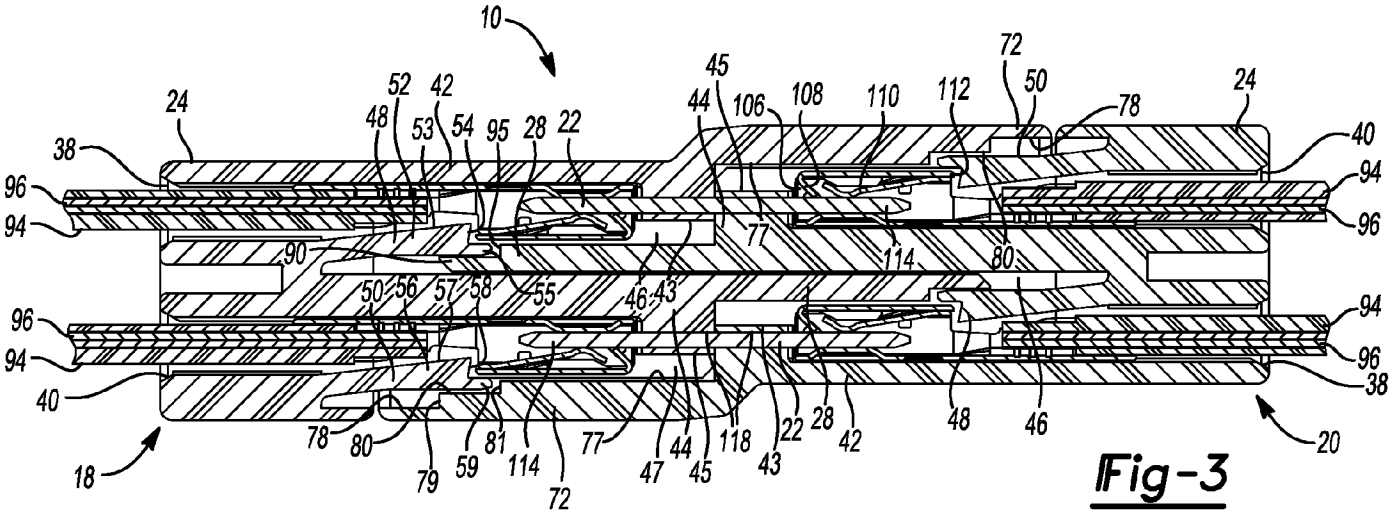
FIG. 3 is a cross-sectional view taken along the line 3-3 of FIG. 1.

With reference to FIGS. 2 and 3, the first and second housings 18, 20 are disposed along a coupling axis A1 (shown in FIGS. 1 and 5) and may each include a body portion 24, an insertion portion 26, one or more first lock arms 48, one or more second lock arms 50, and a first support member 28. The body portion 24, the insertion portion 26 and the first support member 28 may be integrally and unitarily formed from a suitable electrically insulating material, such as a thermoplastic. The body portion 24 may include a first end 30, a second end 32, and first and second sides 34, 36 extending between the first and second ends 30, 32. The first end 30 may include one or more first receptacles 38 and one or more second receptacles 40 extending into the body portion 24. The body portion 24 may include first and second members 42, 44 disposed between the first and second sides 34, 36 and may include first and second stops 43, 45. The first receptacles 38 may extend longitudinally between the first end 30 and the first stop 43 and may extend laterally between the first member 42 and a corresponding first lock arm 48. The second receptacles 40 may extend longitudinally between the first end 30 and the second stop 45 and may extend laterally between the second member 44 and a corresponding second lock arm 50. The first stop 43 and the first lock arms 48 may cooperate with the second member 44 to define a cavity 46. The cavity 46 may extend at least partially between the first and second sides 34, 36 and may communicate with the first receptacles 38. As will be subsequently described, the cavities 46 of the first and second housings 18, 20, respectively, may receive the first support member 28 of the second and first housings 20, 18, respectively, when the first and second housings are in either of the pre-set or full-set positions. The second member 44 may include grooves 47 that may be disposed in-line and communicate with the second receptacles 40.

As shown in FIG. 3, each of the first lock arms 48 can cantilever from the body portion 24 and may partially separate the cavity 46 from a corresponding one of the first receptacles 38. Each first lock arm 48 may be configured to resiliently flex into and away from the cavity 46 to respectively expand and restrict a width of at least a portion of its associated receptacle 38. Each of the first lock arms 48 may include a ramp portion 52, a latch surface 54, and a tab 55. The ramp portion 52 can extend from the body portion 24 and can define a tapered surface 53 that at least partially defines the corresponding the first receptacle 38. The latch surface 54 can be formed on an end of the ramp portion 52 that is opposite to the end of the ramp portion 52 that is coupled to the body portion 24. An included angle between the latch surface 54 and the tapered surface 53 of the ramp portion 52 can be less than or equal to about 90 degrees, for example. The tab 55 can be a projection that extends from the latch surface 54 on a side that is opposite to the tapered surface 53.

Figure 5:
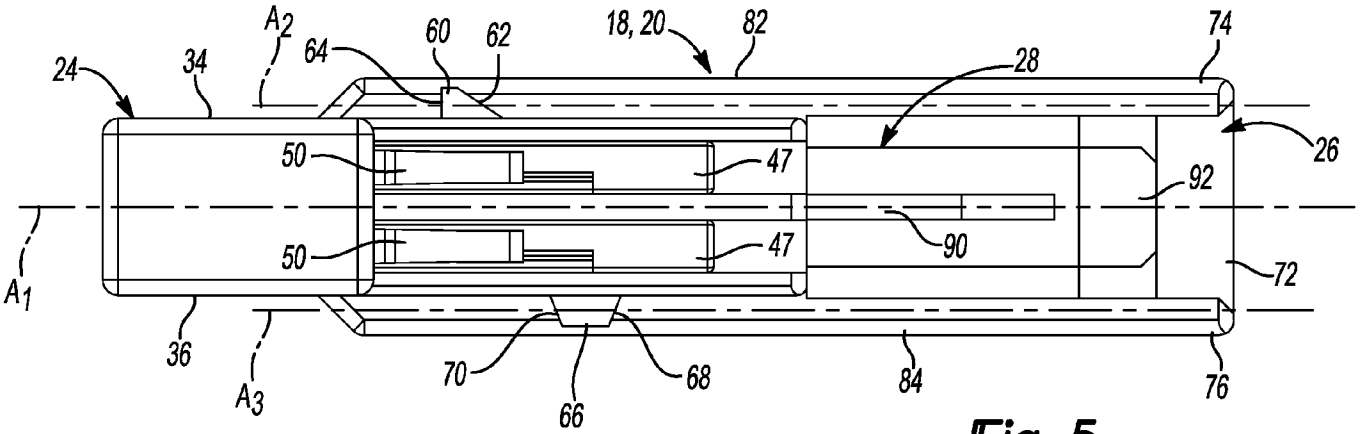
FIG. 5 is a top view of a portion of the connector of FIG. 1 illustrating the first housing in more detail.

As shown in FIGS. 3 and 5, each of the second lock arms 50 can cantilever from the body portion 24 and may extend into an associated one of the grooves 47. Each second lock arm 50 can partially block an in-line path between the associated one of the grooves 47 and a corresponding one of the second receptacles 40 to thereby partially separate the associated one of the grooves 47 from the corresponding one of the second receptacles 40. Each second lock arm 50 may be configured to resiliently flex into and away from its associated groove 47 to respectively expand and restrict at least a portion of the associated receptacle 40. Each second lock arm 50 may include a ramp portion 56, a latch surface 58, and a tab 59. The ramp portion 56 can extend from the body portion 24 and can define a tapered surface 57 that at least partially defines the corresponding the second receptacle 40. The latch surface 58 can be formed on an end of the ramp portion 56 that is opposite to the end of the ramp portion 56 that is coupled to the body portion 24. An included angle between the latch surface 58 and the tapered surface 57 of the ramp portion 56 can be less than or equal to about 90 degrees. The tab 59 can be a projection that extends from the latch surface 58 on a side that is opposite to the tapered surface 57.

Figure 7:
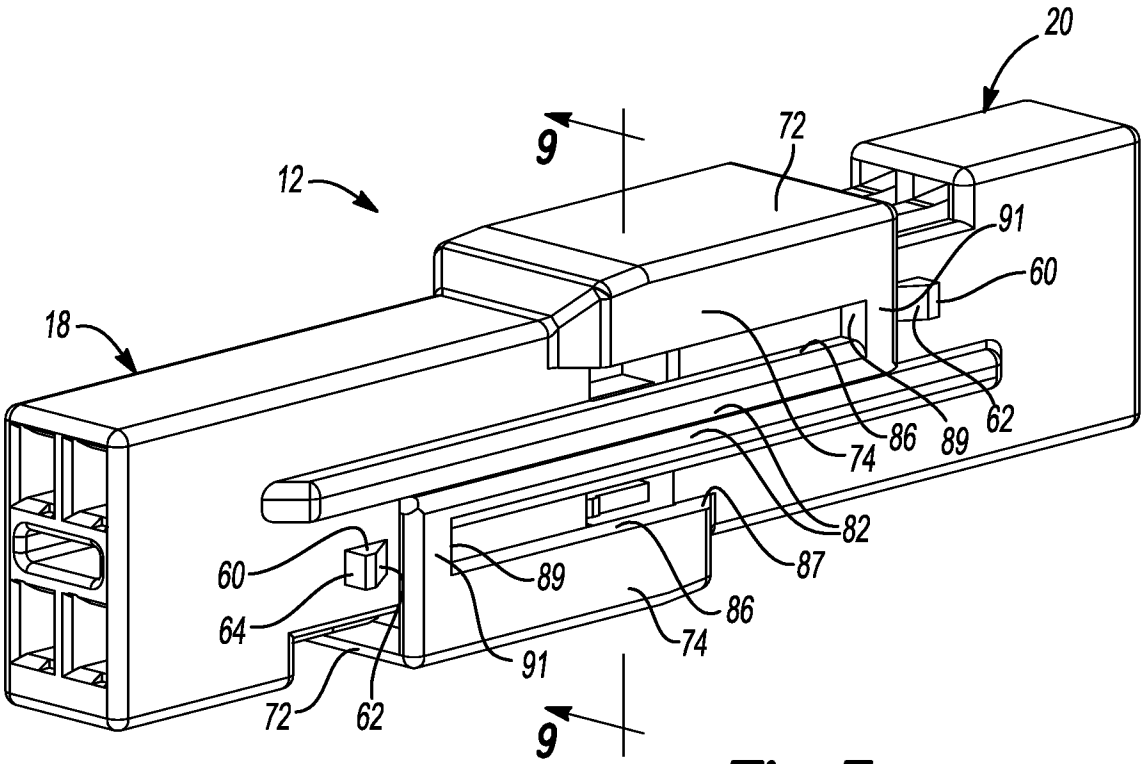
FIG. 7 is a perspective view of the first and second housings in a pre-set position.

With reference to FIGS. 5 and 7, a first protrusion 60 can be coupled to the first side 34 of the body portion 24. The first protrusion 60 can be generally wedge-shaped and may include a ramp surface 62 and a latch surface 64. The ramp surface 62 can extend increasingly outwardly away from the first side 34 with decreasing distance to the latch surface 64. The latch surface 64 can extend perpendicularly from the first side 34.

Figure 6:
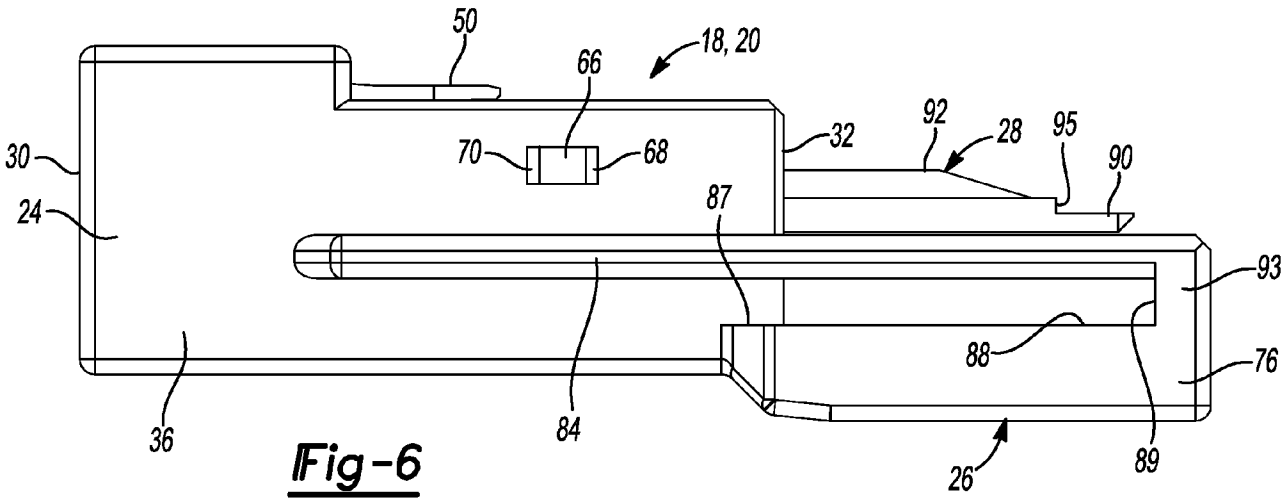
FIG. 6 is a side elevation view of the first housing.

In FIGS. 5 and 6, a second protrusion 66 can be coupled to the second side 36 of the body portion 24. The second protrusion 66 can be wedge-shaped on each of its ends and may include first and second ramp portions 68, 70, respectively. The first ramp portion 68 can extend increasingly outwardly away from the second side 36 with decreasing distance to the second ramp portion 70. Similarly, the second ramp portion 70 can extend increasingly outwardly away from the second side 36 with decreasing distance to the first ramp portion 68.

Figure 4:
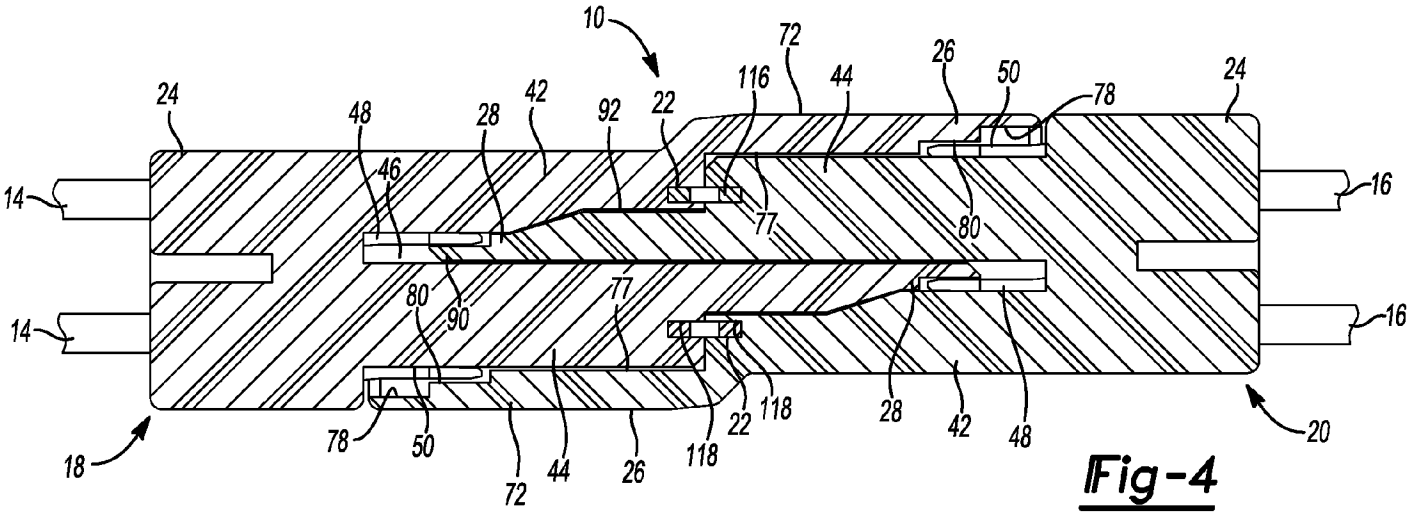
FIG. 4 is a cross-sectional view taken along the line 4-4 of FIG. 1.

With reference to FIGS. 2, 3 and 4, each insertion portion 26 of the first and second housings 18, 20 may extend from the second end 32 of the body portion 24 and may include a second support member 72 and first and second side members 74, 76 cooperating to form a structure with a generally U-shaped lateral cross sectional shape. The second support member 72 and first and second side members 74, 76 may cooperate with the first support member 28 to form a cavity 77 that communicates with the cavity 46 in the body portion 24. The second support member 72 may include a first ledge 78 and a second ledge 80. The first ledge 78 may include a thinner cross-sectional thickness than the second ledge 80 and the remainder of the second support member 72. A first step surface 79 may connect the first and second ledges 78, 80. The second ledge 80 may extend between the first step surface 79 and a second step surface 81. The first and second step surfaces 79, 81 can be substantially perpendicular to the first and second ledges 78, 80. The second ledge 80 may include a thinner cross-sectional thickness than a portion of the second support member 72 disposed between the second step surface 81 and the body portion 24.

Figure 8:
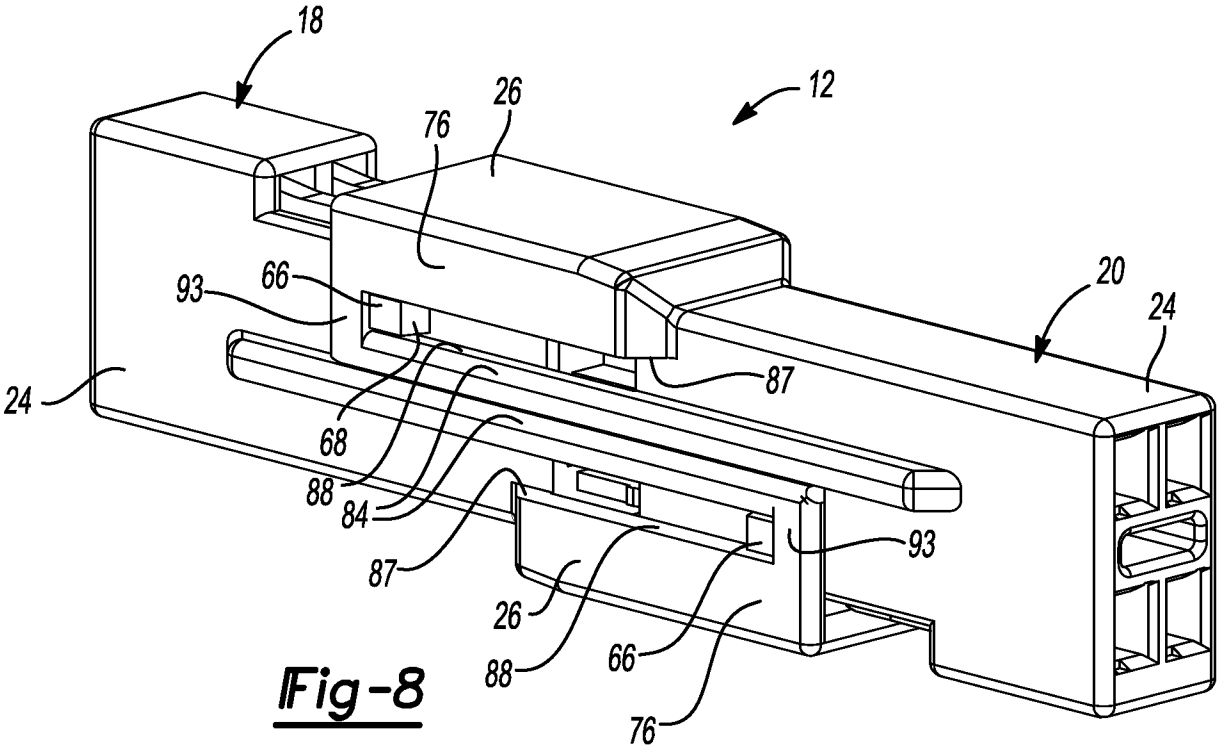
FIG. 8 is a second perspective view of the first and second housings in the pre-set position.

With reference to FIGS. 2 and 5 through 7, a first rail 82 can be coupled to the first side 34 of the body portion 24 and the first side member 74 of the insertion portion 26. The first rail 82 can have a longitudinal axis A2 that can be parallel to the coupling axis A1. A second rail 84 can be coupled to the second side 36 of the body portion 24 and the second side member 76 of the insertion portion 26. The second rail 84 can have a longitudinal axis A3 that can be parallel to the coupling axis A1. The first and second rails 82, 84 may partially define first and second slots 86, 88 formed in the first and second side members 74, 76, respectively. As shown in FIGS. 7 and 8, each of the first and second slots 86, 88 may include an open end 87 and a closed end 89. The closed end 89 of the first slot 86 may be defined by a first latch member 91, which can be integrally formed with and extend between the first rail 82 and the first side member 74. The closed end 89 of the second slot 88 may be defined by a second latch member 93, which can be integrally formed with and extend between the second rail 84 and the second side member 76.

With reference to FIGS. 3 through 6, the first support member 28 may extend from the second end 32 of the body portion 24 and may be generally parallel to the second support member 72. A distal end of the first support member 28 may include a ledge 90. The ledge 90 may be partially defined by a step surface 95 and may include a thinner cross-sectional thickness than the remainder of the first support member 28. The step surface 95 may be substantially perpendicular to the coupling axis A1. A guide member 92 may extend between the ledge 90 and the second end 32 of the body portion 24.

With reference to FIGS. 2 and 3, each of the first and second insulated wire conductors 14, 16 can include a terminal 98. The first and second insulated wire conductors 14, 16 can include an electrically insulating outer sheath or insulation 94 that can surround an electrically conductive inner portion or conductor 96. The terminals 98 can be formed from an electrically conductive material may be connected to an end of a respective one of the insulated wire conductors 14, 16. Each terminal 98 may include an insulation-gripping portion 100, a conductor-gripping portion 102, and a body portion 104. The insulation-gripping portion 100 may be crimped onto or otherwise engaged with the insulation 94 of a corresponding one of the insulated wire conductors 14, 16. The conductor-gripping portion 102 may be crimped and/or soldered onto or otherwise engaged with the conductor 96 of the corresponding insulated wire conductor 14, 16. The body portion 104 of each terminal 98 may include an aperture 106, first and second spring members 108, 110, and a retaining feature 112. In some embodiments, the terminals 98 may be model FLX 0.64 female terminals manufactured by Yazaki Corporation or a YESC 0.64 female terminals manufactured by Yazaki Corporation. In other embodiments, the terminals 98 could be any other suitable type, model, or size.

The busbars 22 may be formed from an electrically conductive material and may include a plurality of legs 114 and a body portion 116 from which the legs 114 extend. Each of the legs 114 may be coupled to a respective one of the first and second housings 18, 20 and can be disposed generally in-line with an associated one of the first and second receptacles 38, 40. In the particular example provided, each of the busbars 22 has four legs 114 that extend from body portion 116 in a manner that provides the busbar 22 with a generally H-shape. The legs 114 may be received in apertures 118 (FIGS. 3, 4 and 9) formed in the first and second stops 43, 45 of the first and second members 42, 44 of the body portion 24 of the first and second housings 18, 20 such that the each of the legs 114 extends into a corresponding one of the receptacles 38, 40.

Each of the busbars 22 can be fixedly coupled (i.e., directly mounted to) one of the first and second housings 18, 20. In the particular example provided, one of the busbars 22 is fixedly coupled to the first housing 18 and a second one of the busbars 22 is fixedly coupled to the second housing 20. Any desired means may be employed to couple the busbars 22 to the first housing 18 and/or the second housing 20, including an interference fit (i.e., between the busbars 22 and an associated one of the first and second housings 18, 20), threaded fasteners, rivets and snap fasteners. In the particular example provided, however, each of the busbars 22 is molded into an associated one of the first and second housings 18, 20.

In some situations, it may be advantageous to partly assemble the first and second housings 18, 20 to one another (i.e., in the pre-set position), assemble the first and second insulated wire conductors 14, 16 to the first and second housings 18, 20 while in the pre-set position to electrically couple pairs of the insulated wire conductors 14 to associated pairs of the insulated wire conductors 16, and to move the first and second housings 18, 20 relative to one another in the full-set position to verify that the terminals 98 of the first and second insulated wire conductors 14, 16 are present and fully coupled to a respective one of the busbars 22.

Figure 9:
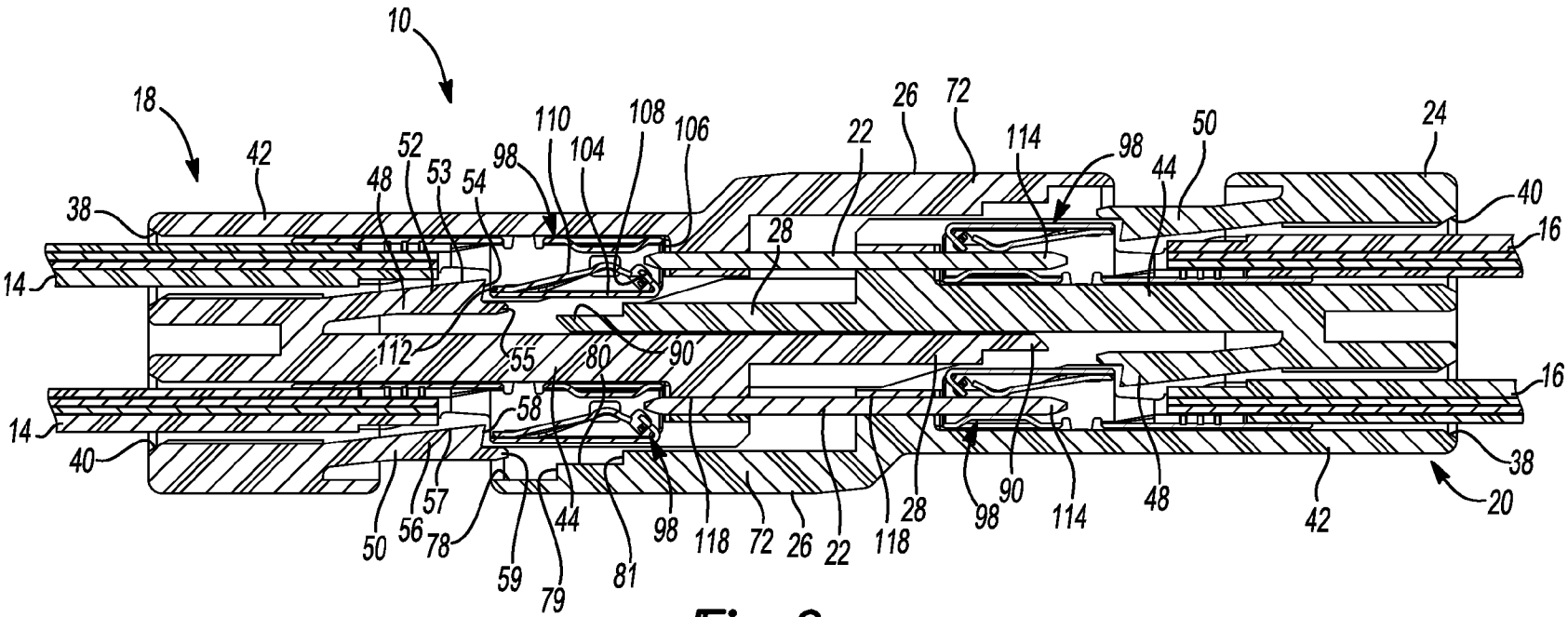
FIG. 9 is a cross-sectional view taken along the line 9-9 of FIG. 7 depicting the first and second housings in the pre-set position.

With reference to FIGS. 7 through 9, the first and second housings 18, 20 can be slid into engagement with each other by placing the first rail 82 of the first housing 18 and the first rail 82 of the second housing 20 substantially parallel to each other and in sliding engagement each other and placing the second rail 84 of the first housing 18 and the second rail 84 of the second housing 20 substantially parallel to each other and in sliding engagement with each other. With the first and second housings 18, 20 in this position relative to each other, the first and second housings 18, 20 can be slid along the coupling axis A1 toward each other such that the first support member 28 of the first housing 18 is inserted between the first and second members 42, 44 of the second housing 20 and the first support member 28 of the second housing 20 is inserted between the first and second members 42, 44 of the first housing 18.

As shown in FIG. 8, when the first and second housings 18, 20 are in the pre-set position, the second protrusion 66 of the first housing 18 may be received in the second slot 88 in the insertion portion 26 of the second housing 20, and the second protrusion 66 of the second housing 20 may be received in the second slot 88 in the insertion portion 26 of the first housing 18. In this position (i.e., the pre-set position), contact between each of the second protrusions 66 and the portion of the second side members 74 that defines an end of the second slot 88 on an opposite one of the first and second housings 18, 20 can restrict or prevent the first and second housings 18, 20 from being withdrawn from other along the coupling axis A1. Accordingly, it will be appreciated that the pre-set position may be a convenient configuration in which a manufacturer of the connector assembly 12 may package and ship the connector assembly 12 to a user of the connector assembly 12, although, the first and second housings 18, 20 can be packaged and shipped separately and/or disconnected from each other. If desired, the insertion portions 26 of the first and second housings 18, 20 may be sufficiently flexible to allow a user to disengage the second protrusions 66 from the second slots 88 to allow the first and second housings 18, 20 to be removed from the pre-set position and completely separated from each other.

With the first and second housings 18, 20 in the pre-set position, the first and second insulated wire conductors 14, 16 can be inserted into corresponding ones of the first and second receptacles 38, 40 such that the terminals 98 engage respective legs 114 of the busbars 22. Insertion of the body portion 104 into an associated one of the receptacles 38, 40 can resiliently flex or drive a corresponding one of the first and second lock arms 48, 50 outwardly into the cavity 46 to thereby expand the width of the first or second receptacle 38, 40. Further insertion of the insulated wire conductors 14, 16 into the respective receptacle 38, 40 permits the terminal 98 to be pushed over an associated one of the legs 114 of a corresponding one of the busbars 22. It will be appreciated that the legs 114 are received through the apertures 106 in the terminals 98 and that the first and second springs 108, 110 of the terminals 98 can flex to permit the legs 114 to be received in the body portions 104. The first and second springs 108, 110 may exert a biasing force on the leg 114 to ensure secure engagement between the terminal 98 and the leg 114 and to ensure robust contact for electrical communication therebetween. In some embodiments, each leg 114 may include one or more barbs 120 that, once received through the aperture 106, restrict or prevent the terminal 98 from being withdrawn from the leg 114.

Once the terminals 98 have been inserted into the first and second receptacles 38, 40 to a depth where the retaining feature 112 on the terminals 98 are aligned with a respective one of the tabs 55, 59, the associated first or second lock arm 48, 50 is allowed to spring back to its normal position shown in FIG. 9. When the terminals 98 are fully installed within their corresponding receptacle 38, 40 (FIG. 9), the latch surface 54, 58 of the corresponding lock arm 48, 50 are disposed in-line with the retaining feature 112 and therefore limit rearward movement of the terminal within the receptacles 38, 40.

With the terminals 98 fully installed in the receptacles 38, 40, the first and second housings 18, 20 can be moved along the coupling axis A1 from the pre-set position (FIGS. 7-9) to the full-set position (FIGS. 1, 3, and 4). To move the first and second housings 18, 20 to the full-set position, the first and second housings 18, 20 may be slid along the rails 82, 84 toward one another such that the first latch members 91 that define the closed ends 89 of the first slots 86 resiliently deflect outwardly as they slide along the ramp surface 62 of an associated one of the first protrusions 60. Accordingly, it will be appreciated that the first latch members 91 can pass over the first protrusions 60 and then deflect inwardly (i.e., when the first and second housings 18, 20 are in the full-set position) so as to abut the latch surface 64 to limit withdrawal of the first and second housings 18, 20 from one another along the coupling axis A1. It will be appreciated that in some embodiments, the latch surface 64 may be angled relative to the first side 34 of the body portion 24 and may still sufficiently restrict or prevent the first and second housings 18, 20 from moving out of the full-set position.

As shown in FIG. 3, when the first and second housings 18, 20 are in the full-set position, the ledges 90 of the first support members 28 of the first and second housings 18, 20 are received between the first lock arm 48 and the second member 44 of the second and first housings 20, 18, respectively. In this manner, the ledges 90 support the first lock arms 48 and restrict or prevent the first lock arms 48 from deflecting or flexing, thereby further restricting or preventing the terminals 98 from being removed from the first receptacles 38. Similarly, the ledges 80 of the second support members 72 of the first and second housings 18, 20 support the second lock arms 50 of the second and first housings 20, 18, respectively, to restrict or prevent the second lock arms 50 from deflecting or flexing, thereby further restricting or preventing the terminals 98 from being removed from the second receptacles 40.

The positioning described above of the ledges 90, 80 relative to the lock arms 48, 50, respectively, in the full-set position can ensure that the terminals 98 are fully received in the receptacles 38, 40. That is, the ledge 90 of each housing 18, 20 cannot be received between the first lock arms 48 and the second member 44 of the other housing 20, 18 if the terminals 98 have not snapped into engagement with the first lock arms 48 and the body portion 104 is still in contact with the ramp portion 52 and causing the first lock arm 48 to remain in the deflected or flexed position. This is because the tab 55 of the first lock arm 48 would interfere with the ledge 90 sliding between the first lock arm 48 and the second member 44 if the first lock arm 48 were still in the deflected or flexed position. Similarly, the ledges 80 of each housing 18, 20 cannot be moved into the position shown in FIG. 3 in which the ledges 80 of the first and second housings 18, 20 support the second lock arms 50 of the second and first housings 20, 18, respectively, if the terminals 98 have not snapped into engagement with the second lock arm 50 and the body portion 104 is still in contact with the ramp portion 56 and causing the second lock arm 50 to remain in the deflected or flexed position. This is because the tab 59 of the second lock arm 50 would restrict or prevent the ledge 80 from sliding into the position shown in FIG. 3 if the second lock arm 50 were still in the deflected or flexed position.

Accordingly, if the user cannot move the first and second housings 18, 20 into the full-set position or if such movement is significantly restricted, the user may check the engagement of the terminals 98 in the corresponding receptacles 38, 40 and fully insert any terminal 98 that is not fully inserted into its receptacle 38, 40. This structure and functionality ensure that the insulated wire conductors 14, 16 will be securely retained in the connector assembly 12 and ensure that electrical communication between the first insulated wire conductors 14 and second insulated wire conductors 16 will remain intact.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A connector comprising:

a first housing having a first body and a lock arm integrally formed with the first body, the first body including a first receptacle, the lock arm being pivotably coupled to the first body and including a surface that defines a cross-sectional area of the first receptacle; and a second housing having a second body including a second receptacle and a support member, the first and second housings being engageable with each other in a first position and a second position and movable relative to each other from the first position to the second position, the lock arm being deflectable relative to the support member when the first and second housings are in the first position, the support member restricting deflection of the lock arm when the first and second housings are in the second position.

2. The connector of claim 1, wherein the first body includes a support member, and the second housing includes a lock arm pivotably coupled to the second body, the lock arm of the second housing being deflectable relative to the support member of the first body when the first and second housings are in the first position, and the support member of the first body restricts deflection of the lock arm of the second housing when the first and second housings are in the second position.

3. The connector of claim 1, wherein the surface of the lock arm is inclined surface.

4. The connector of claim 1, wherein the first and second housings are identical to each other.

5. The connector of claim 1, wherein the first housing includes a first slot and a first protrusion, and the second housing includes a second slot and a second protrusion, and wherein the first protrusion engages the second slot and the second protrusion engages the first slot, and wherein interference between the first protrusion and a closed end of the second slot restricts disengagement between the first and second housings.

6. The connector of claim 5, wherein the first housing includes a third slot and a third protrusion, and the second housing includes a fourth slot and a fourth protrusion, and wherein the third protrusion slidably engages the fourth slot and the fourth protrusion slidably engages the third slot to allow relative movement between the first and second housings from the first position to the second position and restricting the first and second housings from disengaging each other.

7. The connector of claim 1, further comprising a busbar engaging the first and second housings.

8. The connector of claim 1, wherein the first housing includes first and second sides having first and second rails, respectively, and the second housing includes third and fourth sides having third and fourth rails, respectively, the first and second rails slidably engaging the fourth and third rails, respectively.

9. The connector of claim 8, wherein the first and second rails at least partially define first and second slots, respectively, and the third and fourth rails at least partially define third and fourth slots, respectively, one of the first and second slots receiving a protrusion extending from the second housing, and one of the third and fourth slots receiving a protrusion extending from the first housing.

10. The connector of claim 1, wherein the lock arm of the first housing includes a tab and is deflectable between first and second pivotal positions, and the support member of the second housing includes a ledge, and wherein the tab interferes with the ledge when the lock arm is in the first pivotal position such that the first and second housings are restricted from moving into the second position when the lock arm is in the first pivotal position.

11. An assembly comprising:

first and second wires having first and second terminals, respectively;

a busbar contacting the first and second terminals and providing electrical communication therebetween;

a first housing having a first body and a first lock arm, the first body including a first receptacle and a first support member, the first lock arm being pivotably coupled to the first body and adapted to engage the first terminal; and a second housing having a second body and a second lock arm, the second body including a second receptacle and a second support member, the second lock arm being pivotably coupled to the second body and adapted to engage the second terminal, the second housing being identical to the first housing and engaging the first housing to electrically connect the first and second wires, the first support member supporting the second lock arm and restricting deflection of the second lock arm when the first and second housings are in a fully assembled position.

12. The assembly of claim 11, wherein a portion of the first housing is received in the second housing and a portion of the second housing is receive in the first housing.

13. The assembly of claim 11, wherein the first and second terminals are snapped into engagement with the first and second lock arms, respectively.

14. The assembly of claim 11, wherein one of the first and second housings is molded over the busbar.

15. The assembly of claim 11, wherein the first housing includes a first slot and a first protrusion, and the second housing includes a second slot and a second protrusion, and wherein the first protrusion engages the second slot and the second protrusion engages the first slot.

16. The assembly of claim 11, wherein the first lock arm includes a tab and is deflectable between first and second pivotal positions, and the second support member includes a ledge, and wherein the tab interferes with the ledge when the first lock arm is in the first pivotal position such that the first and second housings are restricted from moving into the second position when the first lock arm is in the first pivotal position.

17. The assembly of claim 11, wherein the first housing includes a third receptacle and a third support member, and the second housing includes a fourth receptacle and a fourth support member, wherein at least one of the first and third support members is received in the second housing between the second and fourth support members.

18. A connector comprising a pair of identical monolithic housings each including first and second receptacles, first and second lock arms, and first and second support members, the first support member of one housing being received between the first support member and the first lock arm of the other housing, the first receptacle of the one housing being axially aligned with the second receptacle of the other housing.

19. The connector of claim 18, wherein each of the housings includes third and fourth receptacles, and third and fourth lock arms.

20. The connector of claim 19, wherein each of the first and third receptacles of the one housing are axially aligned with corresponding ones of the second and fourth receptacles of the other housing.

21. The connector of claim 20, wherein the housings are movable relative to each other from a first position to a second position, the first lock arms being deflectable when the housings are in the first position, and wherein the first lock arms of one housing are supported by the first support member of the other housing in the second position to restrict deflection of the first lock arms in the second position.

22. The connector of claim 21, wherein the second support member of one housing restricts deflection of the second lock arms of the other housing when the housings are in the second position.

23. The connector of claim 18, wherein the first lock arm of one housing includes a tab and is deflectable between first and second pivotal positions, and the second support arm of the other housing includes a ledge, and wherein the tab interferes with the ledge when the first lock arm of the one housing is in the first pivotal position such that the housings are restricted from moving relative to each other into a fully assembled position when the first lock arm is in the first pivotal position.

* * * * *